US007798880B2

(12) United States Patent
Takase et al.

(10) Patent No.: US 7,798,880 B2
(45) Date of Patent: Sep. 21, 2010

(54) PROCESS FOR MANUFACTURING PLASMA DISPLAY PANEL AND SUBSTRATE HOLDER

(75) Inventors: Michihiko Takase, Ikoma (JP); Jun Shinozaki, Kyotanabe (JP); Hiroyuki Furukawa, Takatsuki (JP)

(73) Assignee: Panasonic Corporation, Osaka (JP)

( * ) Notice: Subject to any disclaimer, the term of this patent is extended or adjusted under 35 U.S.C. 154(b) by 450 days.

(21) Appl. No.: 11/640,341

(22) Filed: Dec. 18, 2006

(65) Prior Publication Data

US 2007/0275625 A1 Nov. 29, 2007

Related U.S. Application Data

(62) Division of application No. 10/513,956, filed as application No. PCT/JP2004/001632 on Feb. 16, 2004, now Pat. No. 7,195,532.

(30) Foreign Application Priority Data

Feb. 18, 2003 (JP) ..... 2003-039319

(51) Int. Cl.
*H01J 17/49* (2006.01)
*H01J 9/24* (2006.01)
*H01K 1/18* (2006.01)

(52) U.S. Cl. ..... 445/24; 445/25; 313/292; 313/582; 118/500

(58) Field of Classification Search ..... None
See application file for complete search history.

(56) References Cited

U.S. PATENT DOCUMENTS 5,527,393 A * 6/1996 Sato et al. ..... 118/725
6,052,267 A 4/2000 Kasai et al. ..... 361/56
6,059,626 A * 5/2000 Kimura et al. ..... 445/24
6,294,722 B1 9/2001 Kondo et al. ..... 257/466
6,361,389 B1 3/2002 Hogue et al. ..... 445/24
6,841,049 B2 1/2005 Ito et al. ..... 118/500
6,849,560 B2 2/2005 Suezaki et al. ..... 438/758
7,042,553 B2 * 5/2006 An et al. ..... 355/72
7,077,908 B2 * 7/2006 Nogiwa et al. ..... 118/500
2005/0176334 A1 8/2005 Takase et al. ..... 445/24
2006/0068084 A1 3/2006 Shinozaki et al. ..... 118/500

FOREIGN PATENT DOCUMENTS

| | | |
|---|---|---|
| EP | 0 991 049 | 4/2000 |
| JP | 63-303064 | 12/1988 |
| JP | 4-48073 | 2/1992 |
| JP | 5-302175 | 11/1993 |
| JP | 8-134653 | 5/1996 |
| JP | 11-131232 | 5/1999 |
| JP | 2001-316797 | 11/2001 |
| JP | 2002-226964 | 8/2002 |
| JP | 2003-45949 | 2/2003 |

* cited by examiner

*Primary Examiner*—Nimeshkumar D. Patel
*Assistant Examiner*—Natalie K Walford
(74) *Attorney, Agent, or Firm*—Steptoe & Johnson LLP

(57) ABSTRACT

The invention relates to a process for manufacturing plasma display panel and a substrate holder, preventing an occurrence of dust giving an unfavorable effect in a forming process of a film on a substrate of a plasma display panel in a film forming apparatus. When forming the film, a substrate (3) and a dummy substrate (35) are held by a first substrate holder (31) composed of a supporter sustaining underneath the substrate and a restrictor restricting a position of the substrates (3) in a plane direction, and a second substrate holder (32) sustaining the first substrate holder (31).

3 Claims, 7 Drawing Sheets

PROCESS FOR MANUFACTURING PLASMA DISPLAY PANEL AND SUBSTRATE HOLDER

This is a Divisional Application of Ser. No. 10/513,956, filed Nov. 10, 2004, which is a National Stage Filing Under 35 U.S.C. §371 of International Application No. PCT/JP2004/001632, filed Feb. 16, 2004, which claims priority to Japanese Patent Application No. 2003-039319, filed Feb. 18, 2003.

TECHNICAL FIELD

This invention relates to a process for manufacturing plasma display panel (hereinafter, called PDP) known as a display device having a large screen, thin in size, light in weight and on which substrate a film is formed, and to a substrate holder.

BACKGROUND ART

A PDP displays pictures with a gas discharge causing ultraviolet rays and exciting phosphor with the ultraviolet rays.

The PDP is roughly classified into an AC type and a DC type for its driving method, and a surface discharge type and an opposing discharge type for its discharge scheme. Presently, the AC and surface discharge type with three electrodes makes a mainstream of the PDP because of its convenience for producing a high-precision and large screen, and of its simplicity in manufacturing. The AC and surface discharge type PDP is composed of a front panel and a back panel. The front panel has, on its substrate such as of glass, display electrodes each composed of a scanning electrode and a sustain electrode, a dielectric layer covering the electrode, and a protective layer covering the dielectric layer. The back panel has a plurality of address electrodes, a dielectric layer covering the address electrodes, barrier ribs formed on the dielectric layer, and phosphor layers formed on the dielectric layer and sides of the barrier ribs. The front panel and the back panel are oppositely faced so as the display electrodes and the address electrodes cross each other at a right angle forming a discharge cell between the display electrode and the address electrode.

This type of PDP features a higher display speed, a wider view angle, easier production of a large screen and a higher display quality by its self-luminescence, compared to a liquid crystal panel. Because of the features, the PDP is getting a particular attention in flat panel displays and is used for various applications as a display device for public places and as a display device at home for enjoying a large screen picture at home.

In above constitution of the PDP, the protective layer and the display layer of the front panel and the data electrode of the back panel are produced by a film forming method by vaporizing or sputtering for instance, and which example is disclosed in '2001 All about FPD Technology' (Oct. 25, 2000) issued by Electronic Journal Inc., (pp 576 to 580, pp 585 to 588, pp 598 to 600, and pp 629 to 648).

When the film is formed on a substrate of the front panel or of the back panel as described, in order to form the film successively on the substrate, the substrate is sustained by a substrate holder and is conveyed by a conveyor composed of a transfer roller, a wire and a chain by touching or connected with the holder. Because the conveying method is as such, size of the substrate holder is much larger than the substrate. Consequently the film is formed on an exposed zone of the conveyor other than the substrate and stuck there. As the film is stacked on the exposed over and over, a part of the stuck film is chipped off becoming a source of dust in the film forming apparatus. Dust in the apparatus is caught by the film on the substrate or mixed with film forming material and badly affect quality and uniformity of the film on the substrate.

In order to solve above problem, the film which is stuck to the substrate holder has to be removed regularly before it becomes thick enough to be chipped off. However, because the PDP has a large screen size of 42 inches or 50 inches, the substrate is correspondingly heavy and the substrate holder must be strong and heavy enough to stably hold and transport the large and heavy substrate. Removing the stuck film from the substrate holder is therefore a very heavy labor, and operation is difficult and inefficient. In addition to it, the substrate holder must be taken out for removing the film during film forming process, stopping the process and dropping production efficiency.

The present invention is to overcome the problems, and aims to prevent dust to be formed in the film forming apparatus, which badly affects quality of the film when it is formed on the substrate of the PDP, and achieve a good picture quality of the PDP.

DISCLOSURE OF THE INVENTION

To solve above objective, in a process for manufacturing of the invention, a film is formed on a substrate for the plasma display panel by holding the substrate on a substrate holder, a first substrate holder having a plurality of frames is sustained by a second substrate holder, and the substrate and a dummy substrate are sustained by the frame of the first substrate holder.

According to the manufacturing method, dust caused by a peeling or a breaking from the substrate holder is prevented, achieving a high quality film.

DETAILED DESCRIPTION OF PREFERRED EMBODIMENT

Following, a production method of a PDP in accordance with an exemplary embodiment of the present invention is explained with references to the drawings.

Figure 1:
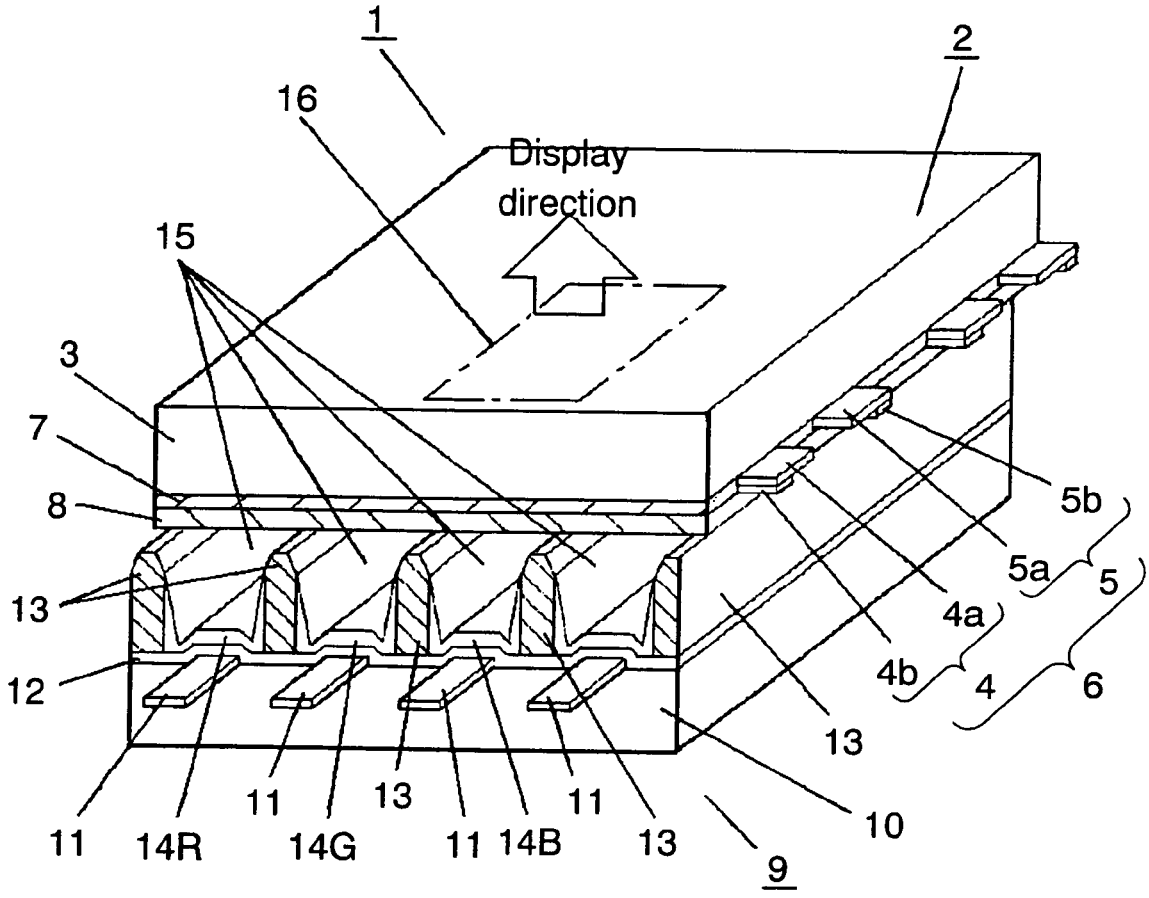
FIG. 1 is a cross-sectional perspective view briefly showing a structure of a PDP produced by a manufacturing method of the PDP in accordance with an exemplary embodiment of the present invention.

First, an example of structure of the PDP is explained. FIG. 1 is a cross-sectional perspective view briefly showing a structure of the PDP produced by a manufacturing method of the PDP in accordance with an exemplary embodiment of the present invention.

Front panel 2 in a front side of PDP 1 includes display electrode 6 composed of scanning electrode 4 and sustain electrode 5 which are formed on a main surface of glass-like transparent insulating substrate 3, dielectric layer 7 covering display electrode 6, and MgO protective layer 8 covering dielectric layer 7. Scanning electrode 4 and sustain electrode 5 are composed of transparent electrode 4*a* and 5*a* laminated by bus electrode 4*b* and 5*b* made of metallic material such as Ag reducing electric resistance.

Back panel 9 in a back side includes address electrode 11 formed on a main surface of glass type dielectric substrate 10, dielectric layer 12 covering address electrode 11, barrier ribs 13 formed between adjacent address electrodes 11, and phosphor layers 14R, 14G and 14B formed between barrier ribs 13.

Front panel 2 and back panel 9 are faced each other holding barrier rib 13 in-between the panels so that display electrode 6 and address electrode 11 are crossed each other at a right angle. A peripheral area of a picture display zone is sealed with sealing material (not illustrated). Discharge space 15 made between front panel 2 and back panel 9 is filled with a discharge gas, 5% of Ne—Xe gas, injected by a pressure of 66.5 kPa (about 500 Torr). An intersection of display electrode 6 and address electrode 11 in discharge space 15 serves as discharge cell 16 (a unit of luminescence).

Figure 2:
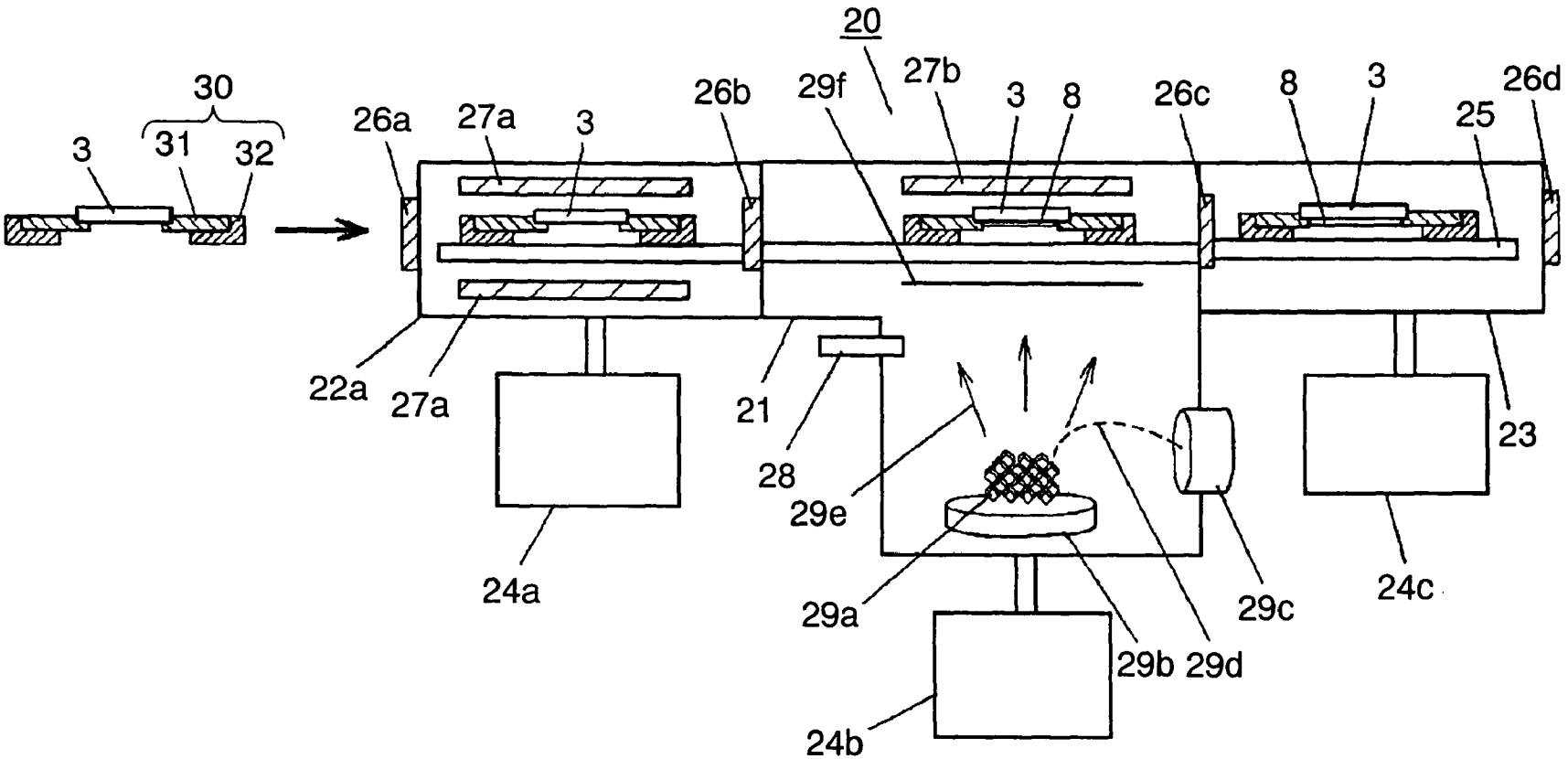
FIG. 2 is a cross-sectional view briefly showing a structure of a film forming apparatus to be used in manufacturing the PDP in accordance with the exemplary embodiment of the present invention.

Next, a manufacturing method of the PDP 1 is described with references to FIGS. 1 and 2.

In producing front panel 2, first forming scanning electrode 4 and sustain electrode 5 both in a stripe shape on substrate 3. Concretely, forming an ITO film on the substrate using a vaporize or sputter film forming process, and then patterning transparent electrodes 4*a* and 5*a* in a stripe shape by a photolithographic method. Next, forming an Ag film on the electrodes by the vaporize or sputter forming process, and then patterning bus electrodes 4*b* and 5*b* in the stripe shape by the photolithographic method. Display electrode 6 composed of scanning electrode 4 and sustain electrode 5 is produced as above.

Then, covering display electrode 6 with dielectric layer 7. Dielectric layer 7 is formed by coating the display electrode with lead paste containing glass by a screen printing method for instance, and then firing it at a prescribed temperature (560° C., for instance) for a prescribed period of time (20 minutes, for instance) to get a prescribed thickness (20 μm, for instance). As the lead paste containing glass, PbO (70 wt %), $B_2O_3$ (15 wt %), $SiO_2$ (10 wt %) and $Al_2O_3$ (5 wt %) mixed with an organic binder (10% of ethyl cellulose dissolved into α-terpineol, for instance) is used. The organic binder is a resin dissolved into an organic solvent, so other material such as acryl resin can be used as the organic binder for ethyl cellulose, and such as butyl carbitole can be used as another organic solvent. Dispersing agent (glyceryl trioleate, for instance) can be mixed with the organic binder.

Then, covering dielectric layer 7 with protective layer 8. Protective layer 8 is made of MgO and is formed by the vaporizing or sputtering film forming process so as the layer 8 acquires a prescribed thickness (approximately 0.5 μm, for instance).

In producing back panel 9, forming address electrode 11 in a stripe shape on substrate 10. More specifically, forming an Ag film a material of address electrode 11 on substrate 10 by the vaporizing or sputtering film forming process, and then patterning it by the photolithographic method.

Next, coating address electrode 11 with dielectric layer 12. Dielectric layer 12 is formed by covering the address electrode with the lead paste containing glass by the screen printing method for instance, and then sintering the unit at a prescribed temperature (560° C., for instance) for a prescribed period of time (20 minutes, for instance) to get a prescribed thickness (approximately 20 μm, for instance).

Then, forming barrier rib 13 in a stripe shape on the dielectric layer. Barrier rib 13 is formed by an identical method to that of dielectric layer 12, namely coating the dielectric layer repeatedly with the lead paste containing glass in a predetermined pattern by the screen printing method, and then sintering it. Space between barrier ribs 13 is approximately 130 μm to 240 μm in a case of 32 to 50 inches HD-TV.

Then finally forming phosphor layer 14R, 14G and 14B composed of fluorescent particles which emit red (R), green (G) and blue (B) lights, in a groove between two adjacent barrier ribs 13. Phosphor layer 14R, 14G and 14B are formed by applying a paste-like luminescent ink composed of fluorescent particles of each color mixed with an organic binder to the groove, and then firing at 400° C. to 590° C. burning out the organic binder and fixing the fluorescent particles to the groove.

Then, putting front panel 2 and back panel 9 together so as display electrode 6 of front panel 2 and address electrode 11 of back panel 9 are crossed each other at a right angle. After applying the sealing material such as seal glass to the peripheral part of the unit of the picture display zone, firing the unit at approximately 450° C. for 10 to 20 minutes for sealing. Discharge space 15 is exhausted to a high vacuum (approximately $1.1\times10^{-4}$ Pa), then an discharge gas such as inert gas of He—Xe and Ne—Xe is injected into the space at a prescribed pressure, completing PDP 1.

As it has been described, various film forming process are employed in the production process of the PDP. As an example of the film forming process, a case of forming MgO protective layer 8 by vaporization is described next by referring to a structure of the film forming apparatus shown in FIG. 2. FIG. 2 is a cross-sectional perspective view briefly showing the structure of film forming apparatus 20 for forming protective layer 8.

Film forming apparatus 20 is made up of vapor deposit room 21 for forming MgO protective layer 8 on substrate 3 by vaporizing MgO, substrate input room 22 for preheating and preliminarily exhausting the substrate 3 before inputting to vapor deposit room 21, and substrate output room 23 for cooling substrate 3 after vaporization and taken out of vapor deposit room 21. Input room 22, vapor deposit room 21, and substrate output room 23 are respectively structured airtight so that inside of each room can be exhausted; and each room has an independent evacuation system 24*a*, 24*b* or 25*c*.

The apparatus is equipped with conveyor 25 composed of a transfer roller, a wire and a chain placed through substrate input room 22, vapor deposit room 21 and substrate output room 23. Outside of film forming apparatus 20 (outside air) and substrate input room 22, substrate input room 22 and vapor deposit room 21, vapor deposit room 21 and substrate output room 23, and substrate output room 23 and outside of film forming apparatus 20 are respectively divided by openable and closable partition walls 26*a*, 26*b*, 26*c* and 26*d*. A degree of vacuum in each room, substrate input room 22, vapor deposit room 21 and substrate output room 23, is kept within a minimum variation by coordinated movement of driving conveyor 25 and opening/closing motion of partition walls 26*a*, 26*b*, 26*c* and 26*d*. By passing substrate 3 from outside of film forming apparatus 20 thorough substrate input room 22, vapor deposit room 21 and to substrate output room 23 and finishing a prescribed process in each room, the substrate is taken out of film forming apparatus 20.

Inside substrate input room 22 and vapor deposit room 21, heat lamps 27*a* and 27*b* are placed for heating substrate 3.

As other structure, one or more of a substrate heating room can be installed between substrate input room 22 and vapor deposit room 21 for heating substrate 3 according to a condition set by temperature profile of substrate 3. One or more of substrate cooling room can also installed between vapor deposit room 21 and substrate output room 23.

Vapor deposit room 21 has duct 28 introducing oxygen contained gas into the deposit room, for keeping oxygen level inside the room proper for vaporization and preventing MgO to become Mg due to deficiency of oxygen. Furthermore, vapor deposit room 21 has hearth 29*b* on which vapor source 29*a* which is particles of MgO are placed, electron gun 29*c*, and a deflection magnet generating a magnetic field (not illustrated). Electron beam 29*d* radiated by electron gun 29*c* is deflected by the magnetic field of the deflection magnet and irradiated on vapor source 29*a* causing MgO vapor stream 29*e* from vapor source 29*a*. Vapor stream 29*e* is accumulated on substrate 3, forming MgO protective layer 8. Vapor stream 29*e* can be shut off by shutter 29*f* upon necessity.

In film forming apparatus 20, substrate 3 is sustained and conveyed by substrate holder 30. Substrate holder 30 is made up of first substrate holder 31 sustaining substrate 3, and second substrate holder 32 sustaining first substrate holder 31 at its peripheral part and conveying whole substrate holder 30 by touching or connected with conveyor 25 of film forming apparatus 20. Substrate 3 is thus conveyed when substrate holder 30 is conveyed.

Figure 3A:
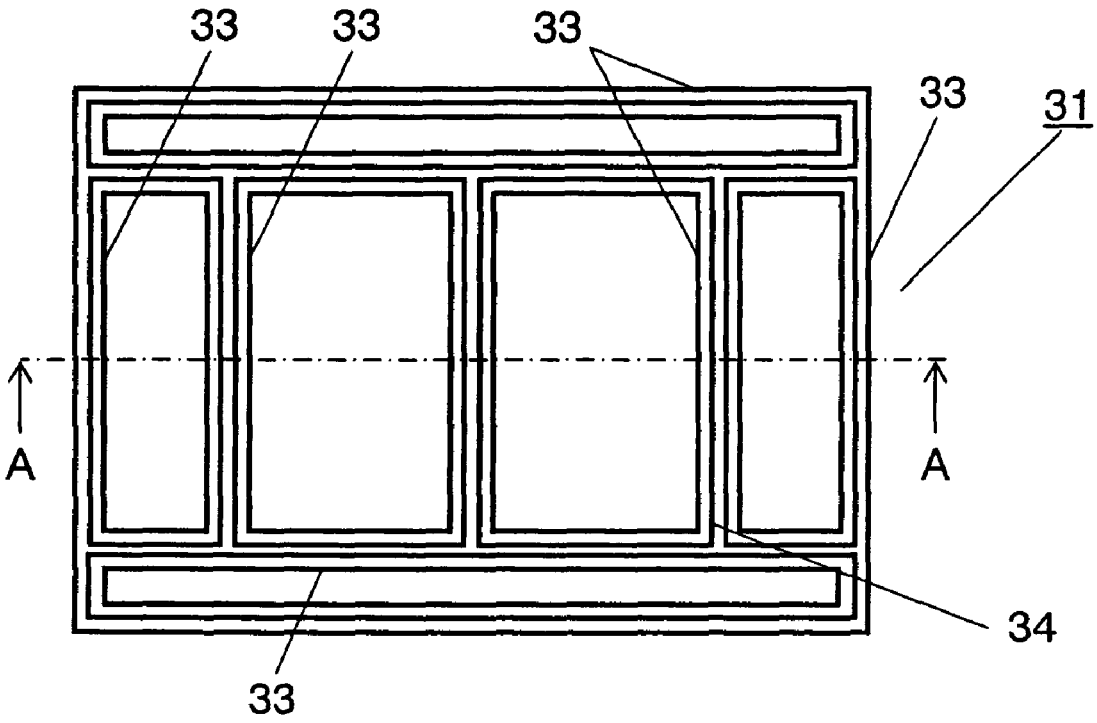
FIG. 3A is a plane view of a first substrate holder to be used for manufacturing the PDP in accordance with the exemplary embodiment of the present invention.
Figure 3B:
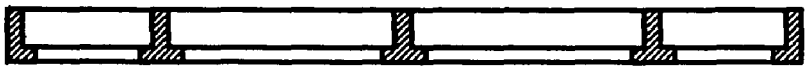
FIG. 3B is a cross-sectional view taken along the line A to A in FIG. 3A.
Figure 4A:
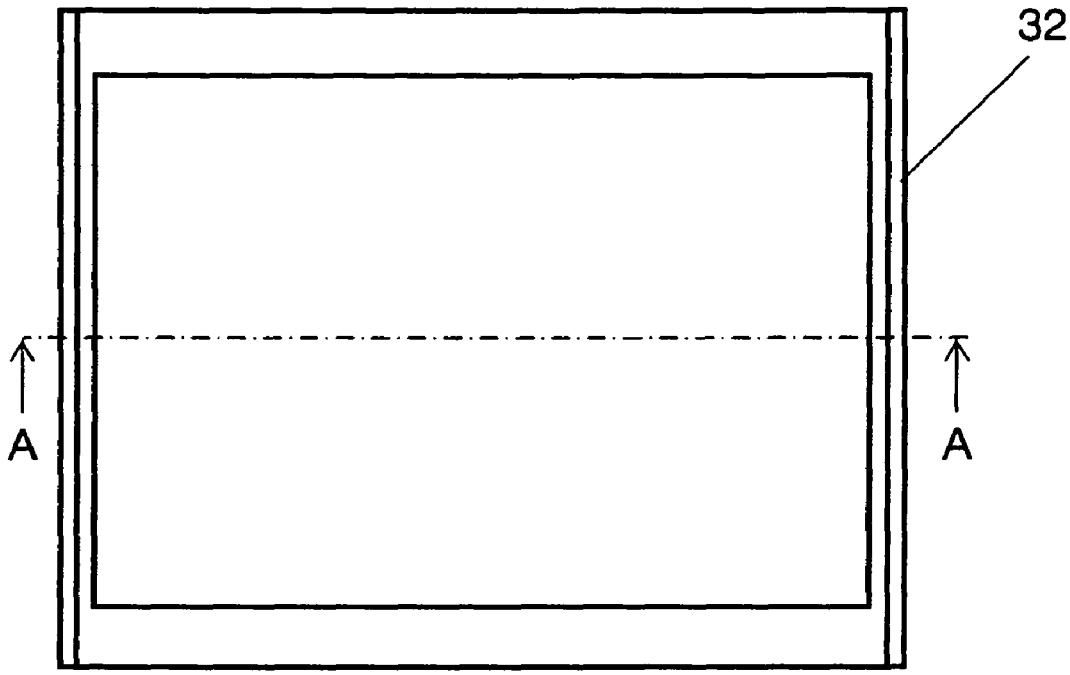
FIG. 4A is a plan view of a second substrate holder to be used for manufacturing the PDP in accordance with the exemplary embodiment of the present invention.
Figure 4B:
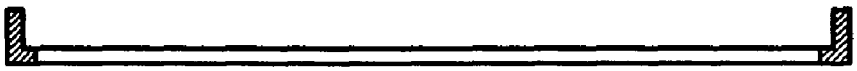
FIG. 4B is a cross-sectional view taken along the line A to A in FIG. 4A.

Next, substrate holder 31 is explained with references to FIGS. 3 to 5.

Figure 5A:
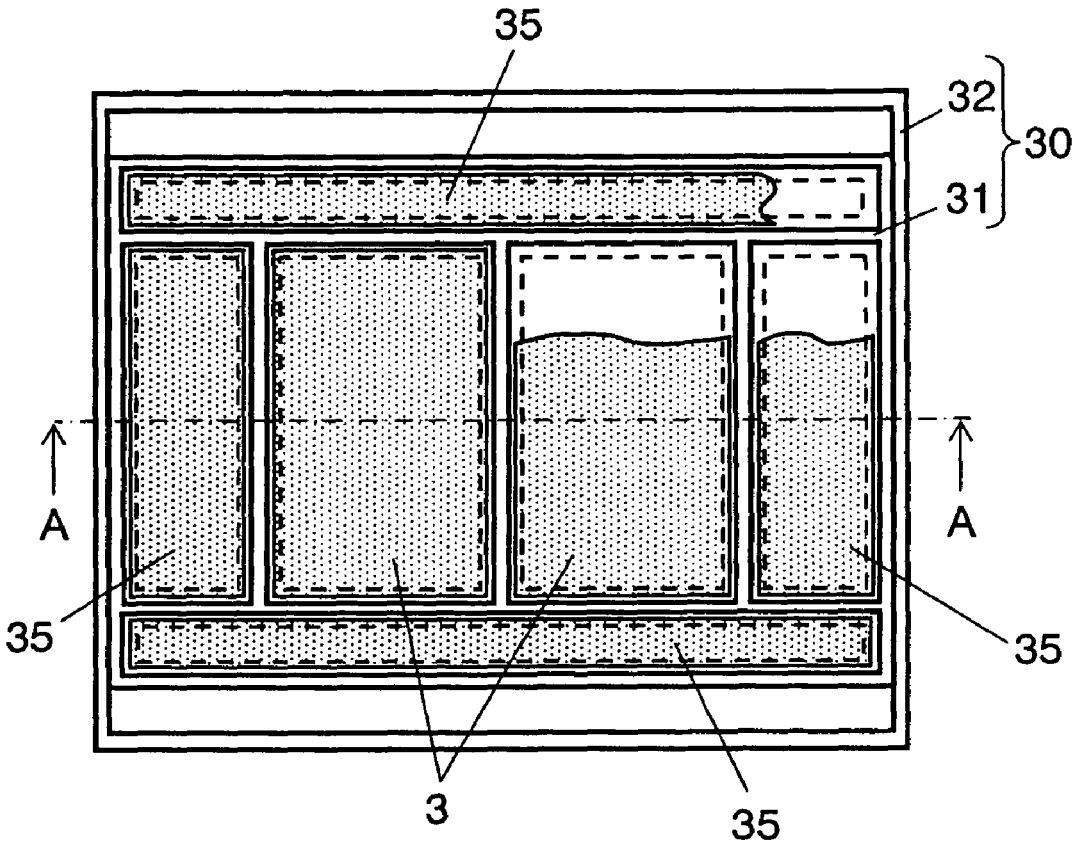
FIG. 5A is a plan view of a substrate holder to be used for manufacturing the PDP in accordance with the exemplary embodiment of the present invention.
Figure 5B:
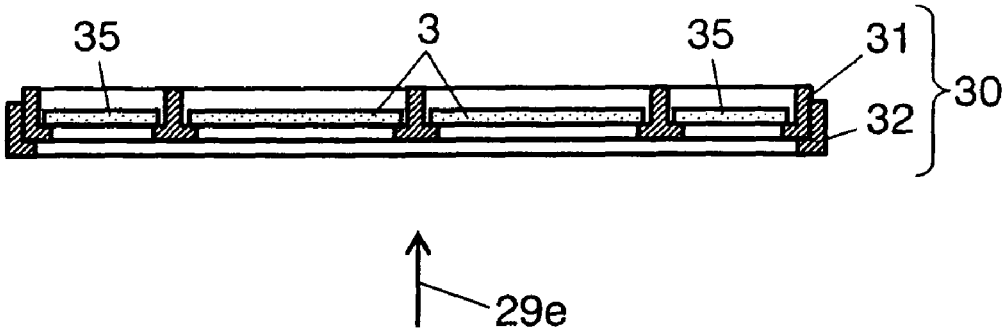
FIG. 5B is a cross-sectional view taken along the line A to A in FIG. 5A.

FIG. 3A is a plan view briefly showing a structure of first substrate holder, and FIG. 3B is a cross-sectional view taken along the line A to A in FIG. 3A. FIG. 4A is a plan view briefly showing a structure of second substrate holder 32, and FIG. 4A is a cross-sectional view taken along the line A to A in FIG. 4A. FIG. 5A is a plan view briefly showing a structure of sustainer 30, in which substrate 3 and dummy substrate 31 are sustained by substrate holder 31 and first substrate holder 31 is sustained by second substrate holder 32. FIG. 5B is a cross-sectional view taken along the line A to A in FIG. 5A.

As shown in FIG. 3, in first substrate holder 31, a plurality of frames 33 are arranged for sustaining a plate shape object like substrate 3. As the structure a plurality of frames 33 are arranged, a variety of constructions are possible, such as a plurality of independent frame-shape objects are arranged, line shaped objects are assembled constituting a ladder, and plate-like objects having an opening cut inside are assembled. In all these cases, frame 33 has sustainer 34 holding substrate 3 or a plate shape object.

Figure 6:
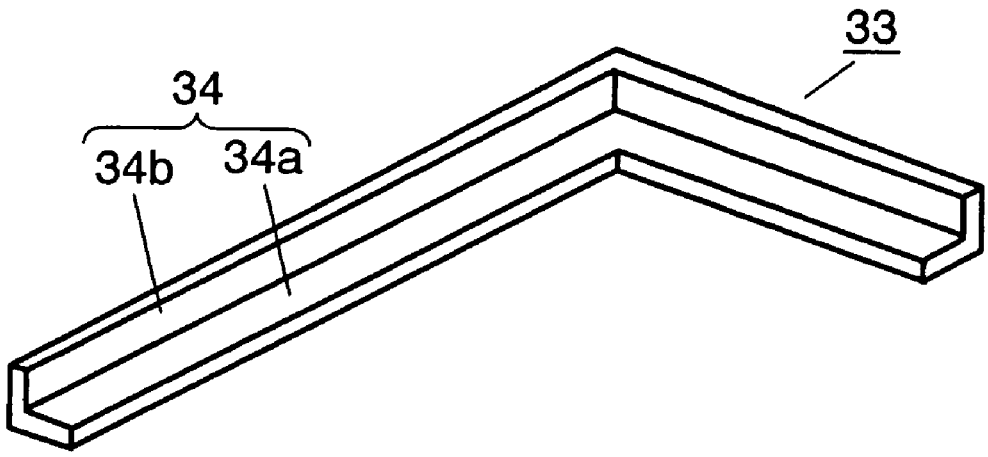
FIG. 6 is a perspective view briefly showing a structure of a sustainer of the substrate holder to be used for manufacturing the PDP in accordance with the exemplary embodiment of the present invention.

FIG. 6 shows a magnified view of a portion of frame 33 briefly illustrating a structure of sustainer 34. As is shown in FIG. 6, frame 33 is in L shape or in reversed T shape in its the cross-sectional view; a horizontal bar of frame 33 sustaining the plate shape object like substrate 3 underneath, serving as supporter 34*a*; and a vertical bar of frame 33 restricting position of the plate shape object substrate 3 in a plane direction, serving as restrictor 34*b*. In this structure, the plate shape object like substrate 3 is held fit inside restrictor 34*b* and put on supporter 34*a*, frame 33 serving as sustainer 34.

Figure 7:
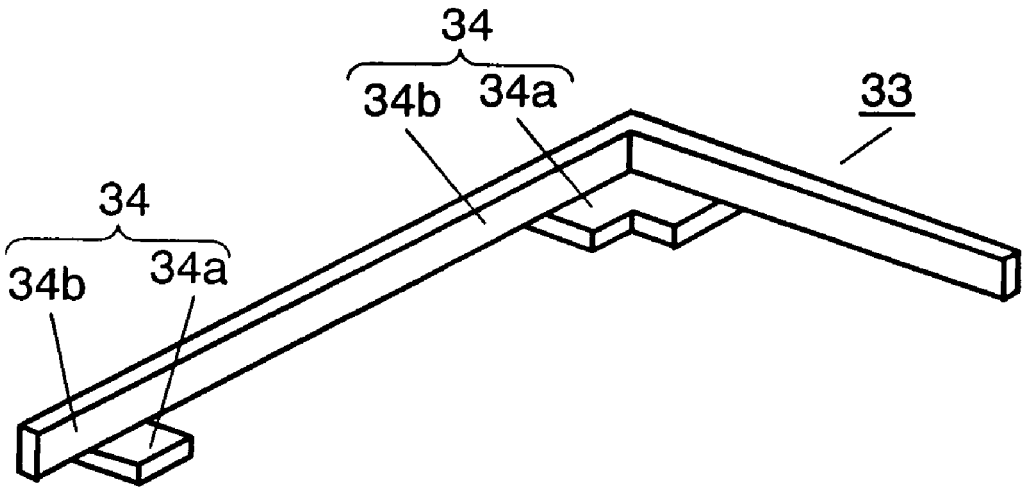
FIG. 7 is a perspective view of other sustainer of the substrate retainer to be used for manufacturing the PDP in accordance with the exemplary embodiment of the present invention.

Sustainer 34 can have other structure as shown in FIG. 7. The sustainer is composed of supporter 34*a* placed at a lower side of frame 33 supporting the plate shape object substrate 3 underneath, and restrictor 34*b* a frame portion of frame 33 restricting position of the plate shape object substrate 3 in the plane direction. The plate shape object restrictor 3 is held fit inside restrictor 34*b* and put on supporter 34*a*.

Figure 8:
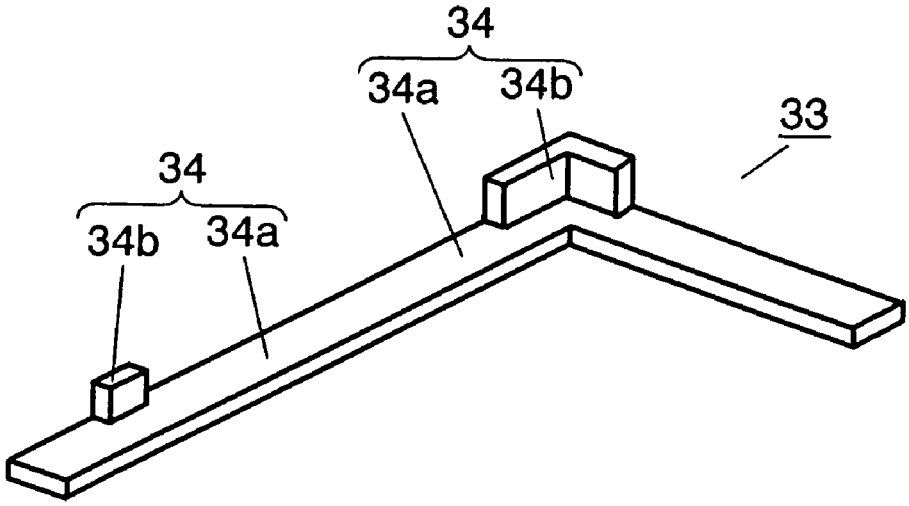
FIG. 8 is a perspective view of still other sustainer of the substrate holder to be used for manufacturing the PDP in accordance with the exemplary embodiment of the present invention.

Sustainer 34 can have still other structure as shown in FIG. 8, in which the sustainer is composed of restrictor 34*b* placed on an upper side of frame 33 restricting position of the plate shape object like substrate 3 in the plane direction, and supporter 34*a* a frame portion of frame 33 supporting underneath the plate-shaped object like substrate 3. The palate shape object like substrate 3 is held fit inside restrictor 34*b* and put on supporter 34*a*.

In first substrate holder 31, frame 33 sustains substrate 3 on which a film is deposited and dummy substrate 35 on which vapor stream 29*e* flying from hearth 29*b* of film forming apparatus 20 other than to substrate 3 is deposited. Conversely, if the vapor stream flying over to area other than substrate 3 can be piled, it is unnecessary for frame 33 to hold dummy substrate 35.

As shown in FIG. 4, second substrate holder 32 sustains first substrate holder 31 at its peripheral sides. With this state, the second substrate holder conveys whole substrate holder 30 by contacting or being connected with conveyor 25 in film forming apparatus 20. Second substrate holder 32 is therefore made strong for holding substrate 3 securely with first substrate holder 31, assuring a safe conveyance of them.

The film is deposited on substrate 3 while substrate 3 held by substrate holder 30 is conveyed by conveyor 25 in film forming apparatus 20. In this process, the film is formed on frame 33 of first substrate holder 31 as well as on substrate 3 and dummy substrate 35 held by the frame of the first sustainer. But, by making frame 33 narrow, most of the film can be formed on substrate 3 and dummy substrate 35

Next, film forming process is explained using FIGS. 1, 2 and 5. As FIG. 5 shows, substrate 3 and dummy substrate 35 are sustained by first substrate holder 31, and first substrate holder 3 is sustained by second substrate holder 32, constituting substrate holder 30. First, putting substrate holder 30 into substrate input room 22 of film forming apparatus 20 shown in FIG. 2, preliminarily exhausting the room by evacuation system 24*a*, and then heating with heat lamp 27*a*. On substrate 3 display electrode 6 and dielectric layer 7 are already formed.

When substrate input room 22 is evacuated to a prescribed level, partition wall 26*b* is opened, and heated substrate 3 on substrate holder 30 is conveyed to vapor deposit room 21 by conveyor 25.

In vapor deposit room 21, substrate 3 is heated by lamp 27*a* for a settled temperature. The settled temperature means 100°

C. to 400° C., preventing deterioration of electrode 6 and dielectric layer 7 due to heat. Then, shutter 29*f* is closed and vapor source 29*a* is preliminarily radiated by electron beam 29*d* of electron gun 29*c* for expelling gas in vapor source 29*a*, and then a gas containing oxygen is introduced through duct 28. When the shutter 29*f* is opened with this condition, MgO vapor stream 29*e* is irradiated onto substrate 3 and dummy substrate 35 held by substrate holder 30 (not illustrated in FIG. 1 or 2). A vaporized MgO is deposited on substrate 3 and dummy 35 held by first substrate holder 31. At this time, frame 33 of first substrate holder 31 has a width at its periphery just enough to hold substrate 3 and dummy substrate 35, consequently an amount of film deposited on frame 33 is very small.

The MgO film deposited on substrate 3 becomes protective layer 8. When vapor deposition film protective layer 8 reaches a certain level of thickness (approximately 0.5 μm), shutter 29*f* is closed and substrate 3 is conveyed to substrate output room 23 passing thorough partition wall 26*c*. Because conveyor 25 is structured to convey substrate holder 30 by touching or connecting only with side parts of second substrate holder 32, quality problem of the vaporized film on substrate 3 due to conveyor 25 is prevented from happening in vapor deposit room 21.

After substrate 3 is cooled in substrate output room 23 below a predetermined temperature, substrate 3 is taken out from sustainer 34 of frame 33 of first substrate holder 31 of substrate holder 30. According to the exemplary embodiment of the present invention, substrate 3 is placed on and supported by supporter 34*a* of frame 33, the substrate 3 can be taken out easily just by lifting up from frame 33. In this way, the operation is very simple.

Figure 9:
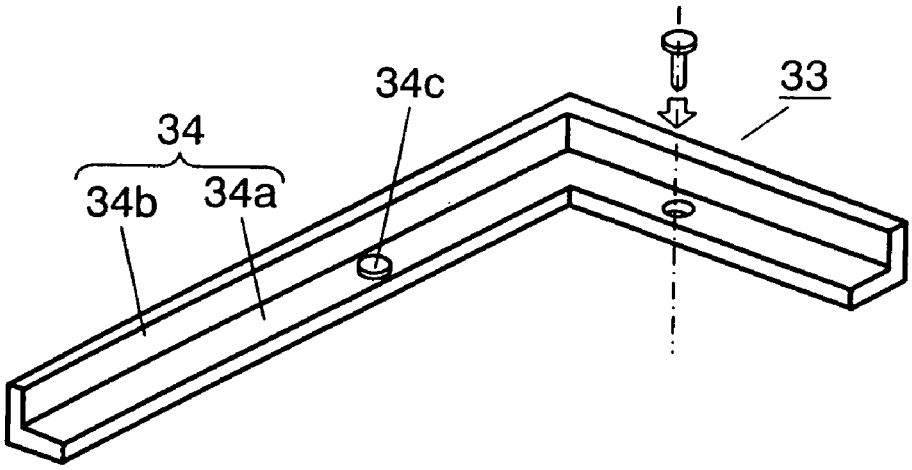
FIG. 9 is a perspective view briefly showing structure of yet other sustainer of the substrate holder to be used for manufacturing the PDP in accordance with the exemplary embodiment of the present invention.

Substrate 3 is requested to be handled carefully not to cause damage such as scratch on its surface. From this point of view, it is desired that absorb material 34*c* is placed where substrate 3 contacts sustainer 34 as illustrated in FIG. 9, especially where the substrate contacts supporter 34*a*, It means that damage on substrate 3 can be avoided by using shock absorber 34*c* which is less harder than substrate 3. If material having lower heat conductivity than frame 33 is used, another effect is achieved that temperature distribution of substrate 3 becomes even. It is desirable that shock absorb material 34*c* is made to be replaceable depending on degree of deterioration.

Substrate holder 30 pulled out vaporized substrate 3 is put again into film forming apparatus 20 holding new substrate 3 to be deposited. At this time, the MgO film is still attached to dummy substrate 35 on first substrate holder 31. If an excessive amount of MgO film is attached to dummy substrate 35 being judged to be peeled off or broken off, only dummy substrate 35 is replaced. With this disposition, the film attached to the parts other than to substrate 3 can be removed before it is peeled off or broken off and becoming dust in vapor deposit room 21. According to the present invention, an amount of the film attached to frame 33 of first substrate holder 31 and second substrate holder 32 is small, so that a need for replacing and rinsing is low. Dummy substrate 35 can be replaced as it becomes necessary, or can be replaced regularly after certain times of film formation is made as predetermined by past data. Dummy substrates 35 can be changed all at once or can be replaced partly depending on an amount of attached film.

Dummy substrate 35 is replaced after it comes out of substrate output room 23 and before input to substrate input room 22. Dummy substrate 35 can be pulled out while substrate 3 is held by frame 33. In the replacement, since dummy substrate 35 is just placed on and sustained by supporter 34*a* of frame 33, dummy substrate 35 can be pulled out from frame 33 merely by pulling up. Thus, the operation is very simple and work efficiency is high.

As described, in the exemplary embodiment of the present invention, the film attached to the area except for substrate 3 can be removed with a very simple work just by changing only dummy substrate 35 on first substrate holder 31 midst of flow of the film forming process without taking substrate holder 30 out of film forming process. Because of the above reason, it is desirable that size and number of dummy substrate 35 are determined not to be burdensome to the replacement work, and size and number of frame 33 of first substrate holder 31 are determined correspondingly.

To remove the film attached to the parts of substrate holder 30 except for substrate 3, dummy substrate 35 can be replaced suspending flow of the film formation process. Even in such case, because substrate holder 30 is so structured as described, removal of the film is simple and interruption of the film forming process is shorter compared to a case using a substrate holder by a conventional structure.

Although a plurality of frames 33 are arranged in first substrate holder 31, since transportation in film forming apparatus 20 is made by second substrate holder 32, a stable transportation is realized and a bad influence on substrate 3 is reduced.

Vapor deposition of MgO on substrate 3 in vapor deposit room 21 can be made either suspending conveyance or continuing the conveyance.

The structure of film forming apparatus 20 is not limited to one above mentioned. A buffer room can be added between rooms for adjusting tact, or a chamber can be added for heating and cooling. Substrate holder 30 can be placed in the chamber when forming a film by batch production method. In either case, the effect of the invention is obtained. In the case substrate holder 30 is placed in the chamber by batch production, substrate holder 30 can be placed on a retainer made in the chamber, or only first substrate holder 31 can be placed on the retainer. When only first substrate holder 31 is placed, the retainer installed in the chamber serves as second substrate holder 32.

In the exemplary embodiment of the present invention, although MgO film formation is explained, the invention still exhibits a following effect when MgO film is formed. The MgO film absorbs gas such as moisture and carbon dioxides. Because of the feature, the MgO film attached to the substrate holder releases the absorbed gas when vaporizing is made, varying a partial pressure of gas inside the vapor deposit room, so that leaving a task that formation of good quality of MgO film becomes difficult. However, according to the present invention, lowering an amount of the absorbed gas is possible by replacing the dummy substrate, so that formation of a good quality MgO film in a stably and easily realized In the above explanation, a case of forming protective layer 8 with MgO is introduced. However, the effect of the invention is not limited to this case, and a similar effect is obtained when display electrode 6 or address electrode 11 is formed with ITO or Ag.

In the above explanation, an electron beam vaporizing film forming method is described. A similar effect is obtained not only by the electron beam vaporizing method but also by hollow cathode ion plating or sputtering method.

INDUSTRIAL APPLICABILITY

The present invention described above prevents occurrence of dust giving an unfavorable effect to film forming process on a substrate of a PDP, so is useful as a manufacturing method of the PDP, realizing a plasma display device having a superior display quality.

REFERENCE MARKS IN THE DRAWINGS

1. plasma display panel
2. front panel
3. substrate
4. scanning electrode
4*a*, 5*a*. transparent electrode
4*b*, 5*b*. bus electrode
5. retain electrode
6. display electrode
7, 12. dielectric layer
8. protective layer
9. back panel
11. address electrode
13. barrier rib
14R, 14B, 14G. phosphor layer
15. discharge space
20. film forming apparatus
21. vapor deposit room
22. substrate input room
23. substrate output room
24*a*, 24*b*, 24*c*. evacuation system
25. conveyor
26*a*, 26*b*, 26*c*. partition wall
27*a*, 27*b*. heat lamp
28. duct
29*a*. vapor source
29*b*. hars
29*c*. electron gun
29*d*. electron beam
29*e*. vapor stream
29*f*. shutter
30. substrate holder
31. first substrate holder
32. second substrate holder
33. frame
34. sustainer
34*a*. supporter
34*b*. restrictor
35. dummy substrate

The invention claimed is:

1. A substrate holder for manufacturing a plasma display panel, wherein the substrate holder is for holding a substrate of a plasma display panel during a process of forming a film on the substrate of the plasma display panel, the substrate holder comprising:

a first substrate holder comprising a frame and a replaceable buffer material for sustaining the substrate, wherein the buffer material is located between the frame and the substrate at an area of contact of the first substrate holder with the substrate; and a second substrate holder for sustaining an outer peripheral part of the first substrate holder, wherein the second substrate holder comprises a frame.

2. The substrate holder of claim 1, wherein the buffer material has less hardness than the substrate.

3. The substrate holder of claim 1, wherein the buffer material has less thermal conductivity than the frame.

* * * * *